US010689954B1

(12) United States Patent
Zhou et al.

(10) Patent No.: US 10,689,954 B1
(45) Date of Patent: Jun. 23, 2020

(54) RESEARCH METHOD OF TRAJECTORY DESIGN AND ON-SITE TRACKING AND ADJUSTMENT OF SHALE OIL HORIZONTAL WELL

(71) Applicant: DAGANG OIL FIELD COMPANY OF CNPC, Tianjin (CN)

(72) Inventors: Lihong Zhou, Tianjin (CN); Xianzheng Zhao, Tianjin (CN); Xiugang Pu, Tianjin (CN); Wenya Jiang, Tianjin (CN); Fengming Jin, Tianjin (CN); Zicang Liu, Tianjin (CN); Quansheng Guan, Tianjin (CN)

(73) Assignee: DAGANG OIL FIELD COMPANY OF CNPC, Tianjin (CN)

( * ) Notice: Subject to any disclaimer, the term of this patent is extended or adjusted under 35 U.S.C. 154(b) by 0 days.

(21) Appl. No.: 16/791,481

(22) Filed: Feb. 14, 2020

(30) Foreign Application Priority Data

Apr. 24, 2019 (CN) ..... 2019 1 0334971

(51) Int. Cl.
*E21B 7/10* (2006.01)
*E21B 41/00* (2006.01)
*E21B 43/30* (2006.01)

(52) U.S. Cl.
CPC ..... *E21B 41/0092* (2013.01); *E21B 7/10* (2013.01); *E21B 43/305* (2013.01)

(58) Field of Classification Search
CPC ..... E21B 7/10
USPC ..... 175/61
See application file for complete search history.

(56) References Cited

U.S. PATENT DOCUMENTS

| | | | | |
|---|---|---|---|---|
| 10,190,998 | B1 * | 1/2019 | Zhou | G01N 23/2055 |
| 2011/0100712 | A1 * | 5/2011 | Poedjono | E21B 47/02208 175/45 |
| 2011/0153300 | A1 * | 6/2011 | Holl | E21B 47/022 703/10 |
| 2018/0216441 | A1 * | 8/2018 | Gu | E21B 41/0092 |
| 2019/0212460 | A1 * | 7/2019 | Zhao | G01V 1/302 |
| 2019/0325331 | A1 * | 10/2019 | Benhallam | G06N 20/00 |

* cited by examiner

*Primary Examiner* — Taras P Bemko
(74) *Attorney, Agent, or Firm* — Calfee, Halter & Griswold LLP

(57) ABSTRACT

The present invention discloses a research method of trajectory design and on-site tracking and adjustment of a shale oil horizontal well, including identification and evaluation of shale oil sweet spots, optimal selection and trajectory design of the horizontal well, and on-site tracking and adjustment of the shale oil horizontal well. The "four-optimal and two-fine" practice in the research method of trajectory design and on-site tracking and adjustment of the shale oil horizontal well of the present invention lays a foundation for high and stable production of shale oil in closed lake basins and the integration of production and reserves increase. It provides a set of technical methods for the design and research of optimal selection of horizontal well locations and dynamic tracking analysis of drilling in shale oil development areas, and has great significance for reference and popularization.

8 Claims, 5 Drawing Sheets

RESEARCH METHOD OF TRAJECTORY DESIGN AND ON-SITE TRACKING AND ADJUSTMENT OF SHALE OIL HORIZONTAL WELL

CROSS REFERENCE TO RELATED APPLICATIONS

This application claims priority to Chinese Application No. 201910334971.2, filed on Apr. 24, 2019, entitled "RESEARCH METHOD OF TRAJECTORY DESIGN AND ON-SITE TRACKING AND ADJUSTMENT OF SHALE OIL HORIZONTAL WELL", which is specifically and entirely incorporated by reference.

FIELD OF THE INVENTION

The present invention relates to a research method, specifically a research method of trajectory design and on-site tracking and adjustment of a shale oil horizontal well, and pertains to the technical field of comprehensive geological evaluation of petroleum exploration.

BACKGROUND OF THE INVENTION

The $Ek_2$ of Cangdong Sag is dominated by depression-basin-type sedimentation. A set of fine-grained sedimentary rock has been stably developed in large areas in the main body of the lake basin, and mainly includes four major rock types: clay rock (with a grain size of less than 0.05 mm), fine-grained felsic sedimentary rock, fine-grained mixed sedimentary rock, and dolomite, with lamellation and texture development, collectively referred to as shale strata, with a high brittleness index. The closed lake basin which is relatively oxygen deficient and contains brackish water during the deposition period of the $Ek_2$ is beneficial to the preservation and enrichment of organic matters in the middle of the lake basin. Three major types of rock can be used as reservoirs and also hydrocarbon source rock, with good organic matter types and high abundance, and conform to the good-very good level of hydrocarbon source rock according to comprehensive evaluation based on various indicators. Based on test analysis of a system cored well, an "iron pillar" of a seven-property relationship among source rock, lithology, electrical property, physical property, brittleness, oil-bearing probability and earth stress is established, and it is clear that seven sweet spot strata have developed in the longitudinal direction of the $Ek_2$, in which the source and reservoir are integrated, with large-area joined oil-bearing characteristics. A favorable area of shale oil is 260 km2, with a resource quantity of about 680 million tons. The potential for shale oil exploration is great.

In recent years, multiple wells in the main body of the lake basin have produced industrial oil flow, which confirms that shale oil is a replacement resource for the next step of increasing reserves and production. However, there are also prominent problems. Shale oil vertical wells have a high yield in the initial stage, but generally have a rapid decline in production, and difficulty in stable yield. To this end, Dagang Oil Field actively promotes the geological and engineering integration in this area, explores the implementation of horizontal shale oil wells, in the hope of achieving stable and high production of shale oil, and lays a foundation for the establishment of a pilot area for efficiently increasing reserves and production of shale oil.

At present, the prospecting of shale oil in Dagang Oil Field and other exploration areas in China is still in the exploration and research stage. In implementations of optimal selection of shale oil horizontal wells, there is still a lack of a perfect technical series as a reference, and the optimal selection and implementation methods of conventional horizontal wells are not suitable for guiding the deployment of shale oil horizontal wells, so there is an urgent need for a research method of trajectory design and on-site tracking and adjustment of a shale oil horizontal well.

SUMMARY OF THE INVENTION

An objective of the present invention is to provide a research method of trajectory design and on-site tracking and adjustment of a shale oil horizontal well, so as to solve the aforementioned problems.

The present invention achieves the foregoing objective by the following technical solution: a research method of trajectory design and on-site tracking and adjustment of a shale oil horizontal well, including the following steps:

Step A: Identification and Evaluation of Shale Oil Sweet Spots based on analytical and assay results of a system-cored well, carrying out research on a seven-property relationship among source rock, lithology, electrical property, physical property, brittleness, oil-bearing probability and earth stress, establishing a standard for geophysical response characteristics of shale oil layers for a single well, and determining planar distribution of sweet spots;

Step B: A "Four-Optimal" Method for Trajectory Design of the Shale Oil Horizontal Well (1) optimal selection of a target area: selecting a favorable exploration target area based on the thickness and buried depth of a shale oil sweet spot interval, and its coupling relationship with the degree of thermal evolution of shale;

(2) optimal selection of a target layer: carrying out fine correlation of oil layers in the optimal target area, determining an optimal sweet spot interval based on the principles of a large oil layer thickness, stable distribution, a high drilling success rate of a known well, and easy identification of seismic characteristics in logging;

(3) optimal selection of a target direction: comprehensively analyzing factors such as attitude of stratum, fault influence, and fracture development direction of the determined target layer, and selecting an optimal drilling direction; and (4) optimization of a trajectory: carrying out fine seismic calibration, and further optimizing a horizontal well trajectory scheme based on a drilling direction determined by the optimal target direction to ensure a maximum drilling success rate of the optimal sweet spot interval; and Step C: A "Two-Fine" Method for Tracking and Adjustment of the Shale Oil Horizontal Well (1) fine analysis and accurate target entering: during a drilling process, timely analyzing the accuracy of a stratum velocity and the reasonableness of a seismic interpretation scheme, and timely making adjustments to ensure precise target entering; and (2) fine tracking to prevent off-target: performing fine correlation according to comprehensive mud logging data and a logging-while-drilling curve, and correcting the trajectory to ensure the drilling success rate of a high-quality small layer.

Preferably, in step A, a standard for identifying shale oil sweet spot intervals is established to identify sweet spots for a single well and determine planar distribution of sweet spots, by using the following logging data: interval transit time, natural gamma, resistivity, and nuclear magnetic logging.

Preferably, in optimal selection of a target area of step B, seismic interpretation and structural mapping are carried out on the top of the shale oil sweet spot interval, and a Ro contour map is drawn according to analytical and test results, wherein the sweet spot buried depth, the degree of evolution of shale and the thickness of the sweet spot interval are coupled to select a favorable exploration target area.

Preferably, in optimal selection of a target layer of step B, fine correlation of oil layers for wells is carried out in subdivisional small layers by using known wells, and a small layer with a large thickness and stable distribution is selected as an objective layer.

Preferably, in optimal selection of a target direction of step B, the attitude of stratum factor indicates that the stratum is as flat and straight as possible with few flexural structures; the fault influence factor indicates that the well trajectory is 150 m or above away from a fault, and the fracture development direction factor indicates that an included angle between the direction of the well trajectory and the direction of a maximum horizontal principal stress is an acute angle greater than 30°.

Preferably, in optimization of a trajectory of step B, a relationship is established between clear geological information of small layers of the oil layers and a seismic reflection event through fine well-seismic calibration, and the seismic event is endowed with geological significance, to increase the horizontal footage in an optimal small layer.

Preferably, in fine analysis and accurate target entering of step C, horizon calibration is carried out timely by using logging curves of sonic waves, resistivity, natural gamma and the like, and the velocity accuracy is analyzed; and constraint and verification are carried out by using multiple sets of data and multiple interpretation schemes.

Preferably, in fine tracking to prevent off-target of step C, velocity fitting is carried out in conjunction with adjacent well data, so that the stratum velocity is most accurate, thereby obtaining the most reasonable actual trajectory.

Specifically, a research method of trajectory design and on-site tracking and adjustment of a shale oil horizontal well of the present invention includes the following steps:

(1) Identification and Evaluation of Shale Oil Sweet Spots based on analytical and assay results of a lithological mineral content, oil content (S1), TOC, Ro and the like of a system-cored well, carrying out research on a seven-property relationship among source rock, lithology, electrical property, physical property, brittleness, oil-bearing probability and earth stress, establishing a standard for identifying shale oil sweet spot intervals, by using logging data such as interval transit time, natural gamma, resistivity and nuclear magnetic logging, identifying shale oil sweet spots for a single well and determining sweet spot area and thickness distribution characteristics;

(2) A "Four-Optimal" Method for Trajectory Design of the Shale Oil Horizontal Well ① optimal selection of a target area: performing seismic interpretation and industrialization mapping by using the top of a shale oil sweet spot interval as a plotting layer, drawing a Ro contour map of a shale oil development zone according to geochemical analysis and test results, and determining thermal evolution characteristics of shale; and selecting a favorable exploration target area of a horizontal well based on the thickness and buried depth of the shale oil sweet spot interval, and its coupling relationship with the degree of thermal evolution of shale;

② optimal selection of a target layer: carrying out fine correlation of oil layers for wells in subdivisional small layers from step (2) ①, selecting a small layer with a relatively large thickness (20 m or above), high free hydrocarbon content, high test oil yield, obvious gas logging abnormality, and stable lateral distribution as an objective layer, and at the same time, using a layer with obvious change characteristics in a logging curve shape and value as a comparative marked bed in the area, which has stable and continuous seismic reflection characteristics and is easy to track, thereby determining an optimal objective interval;

③ optimal selection of a target direction: selecting an optimal drilling direction through geological and engineering combined analysis, wherein for the favorable target layer determined in step (2) ②, three factors are considered: attitude of stratum, fault influence, and fracture initiation direction; firstly, a direction in which the stratum is as flat and straight as possible with few flexural structures is preferred, which is beneficial for tracking and drilling along the layer; secondly, the distance from a fault is preferably 150 m or above to prevent pressure release from the fault during a fracturing process to affect the fracturing effect; and thirdly, the intersection angle of the horizontal well trajectory and the maximum principal stress is as vertical as possible, and at least not less than 30°, because engineering analysis shows that the fracturing effect is best when the horizontal well trajectory is vertical to the direction of the maximum principal stress of the stratum; and ④ optimization of a trajectory: carrying out fine seismic calibration, so that a relationship is established between geological information of small layers of the oil layers and a seismic reflected wave event through fine well-seismic calibration, wherein different phases of the event correspond to the small layers of the oil layers, and the seismic event is endowed with geological significance; and further optimizing a horizontal well trajectory scheme based on the drilling direction determined in step (2) ③ to increase the horizontal footage in an optimal small layer and ensure a maximum drilling success rate of an optimal sweet spot interval; and (3) A "Two-Fine" Method for On-Site Tracking and Adjustment of the Shale Oil Horizontal Well ① fine analysis and accurate target entering: during a drilling process, timely carrying out horizon calibration by using logging curves, and analyzing the accuracy of a velocity; carrying out constraint by using multiple sets of data and multiple interpretation schemes to ensure the reasonableness of a seismic geological interpretation; timely adjusting trajectory control parameters according to actual drilling conditions, to ensure accurate target entering; and ② fine tracking to prevent off-target: carrying out velocity fitting in conjunction with adjacent key well data and the present well data, so that the stratum velocity is most accurate, thereby obtaining the most reasonable actual trajectory; and at the same time performing fine stratum correlation according to comprehensive mud logging data and logging-while-drilling data, and correcting the trajectory in time to ensure the drilling success rate of a high-quality small layer.

The present invention has the following beneficial effects: the research method of trajectory design and on-site tracking and adjustment of the shale oil horizontal well of the present invention is reasonable in design; and by establishing the standard for evaluating shale oil sweet spots, determining the planar distribution range, carrying out comprehensive evaluation using multiple parameters of lithologic association characteristics, resistivity, gas logging abnormal value, free hydrocarbon content and the like, carrying out fine correlation of oil layers in subdivisional small layers, to select the optimal sweet spot interval, the maximum effectiveness of the horizontal footage is ensured. Through fine calibration, different phases of the event correspond to the small layers of the oil layers, and fine correlation of small layers is carried out in seism, so that the precision of seismic interpretation is improved, and an important reference is provided for trajectory optimization. Optimal selection of the well location is carried out in conjunction with engineering. The consideration of the optimal trajectory direction for engineering lays a foundation for a good effect of later large volume fracturing and achieves geological and engineering integration. During drilling, fine well-seismic calibration is performed timely to identify a velocity difference, and multiple sets of data and interpretation schemes are used for mutual verification to select the most reasonable velocity and interpretation scheme, so that the target entering success rate is increased. During drilling of a horizontal interval, velocity fitting is performed by using an adjacent well velocity, and fine correlation is carried out timely according to comprehensive mud logging data and logging-while-drilling data, and trajectory parameters are corrected in time, so that the drilling success rate of a high-quality small layer is improved. The research method of trajectory design and on-site tracking and adjustment of the shale oil horizontal well of the present invention is applied in the DG area, and the drilling success rate of the oil layers reaches 96%. The combination of the technical method and the shale oil exploration practice achieves a good effect.

DETAILED DESCRIPTION OF THE EMBODIMENTS

Figure 1:
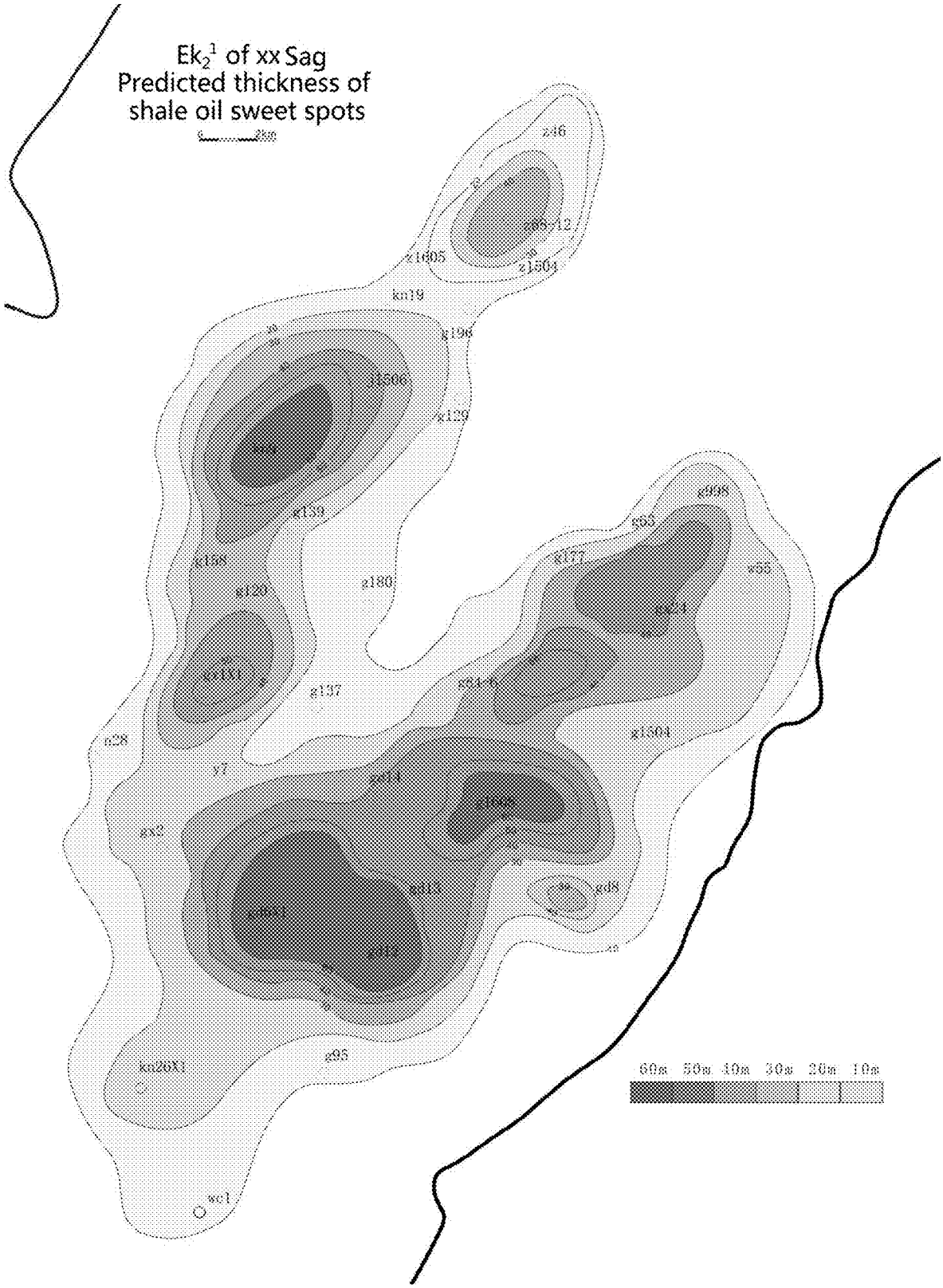
FIG. 1 is a schematic diagram illustrating the thickness of shale oil sweet spots in the present invention.

A clear and complete description of the technical solutions in the embodiments of the present invention will be given below in conjunction with the drawings in the embodiments of the present invention. Apparently, the embodiments described are part of, rather than all of, the embodiments of the present invention. All other embodiments obtained by those of ordinary skill in the art without creative work, based on the embodiments in the present invention, fall into the protection scope of the present invention.

Referring to FIGS. 1-5, a research method of trajectory design and on-site tracking and adjustment of a shale oil horizontal well includes the following steps:

Step A: Identification and Evaluation of Shale Oil Sweet Spots based on analytical and assay results of a lithological mineral content, oil content (S1), TOC, Ro and the like of a system-cored well, establishing a standard for identifying shale oil sweet spot intervals, by using logging data such as interval transit time, natural gamma and resistivity of drilled wells, and nuclear magnetic logging of vertical wells for shale oil drilling, by technical means of a "cross plot", "curve interaction" or the like, through calibration of oil layer testing results; identifying shale oil sweet spots for a single well and determining sweet spot area and thickness distribution characteristics with an oil group as a unit;

Step B: A "Four-Optimal" Method for Trajectory Design of the Shale Oil Horizontal Well (1) optimal selection of a target area: performing seismic interpretation and industrialization mapping by using the top of a shale oil sweet spot interval as a plotting layer, drawing a Ro contour map of a shale oil development zone according to geochemical analysis and test results of a research area, and determining thermal evolution characteristics of shale; and selecting a favorable exploration target area of a horizontal well based on the thickness and buried depth of the shale oil sweet spot interval, and its coupling relationship with the degree of thermal evolution of shale;

(2) optimal selection of a target layer: based on a comparison in the optimal target area with an oil group as a unit in the past, further carrying out fine correlation of oil layers for wells in segmented and subdivisional small layers, selecting a small layer with a relatively large thickness (20 m or above), high free hydrocarbon content, high test oil yield, obvious gas logging abnormality, and stable lateral distribution as an objective layer, at the same time, using a layer with obvious change characteristics in an interval transit time curve shape and deep resistivity curve value as a comparative marked bed in the area, and determining a layer with stable and continuous seismic reflection characteristics and easy to track as an optimal objective interval;

(3) optimal selection of a target direction: selecting an optimal trajectory direction through geological and engineering combined analysis, wherein for the favorable target layer to determine an optimal target direction, three factors are considered: attitude of stratum, fault influence, and fracture initiation direction; firstly, a direction in which the stratum is as flat and straight as possible with few flexural structures is preferred, which is beneficial for tracking and drilling along the layer; secondly, the distance from a fault is preferably 150 m or above to prevent pressure release from the fault during a fracturing process to affect the fracturing effect; and thirdly, the intersection angle of the horizontal well trajectory and the maximum principal stress is as vertical as possible, and at least not less than 30°, because engineering analysis shows that the fracturing effect is best when the horizontal well trajectory is vertical to the direction of the maximum principal stress of the stratum; and (4) optimization of a trajectory: carrying out fine seismic calibration, so that a relationship is established between geological information of small layers of the oil layers and a seismic reflected wave event through fine well-seismic calibration, wherein different phases of the event correspond to the small layers of the oil layers, and the seismic event is endowed with geological significance; and further optimizing a horizontal well trajectory scheme based on a drilling direction determined by the optimal target direction to increase the horizontal footage in an optimal small layer and ensure a maximum drilling success rate of an optimal sweet spot interval; and Step C: A "Two-Fine" Method for Tracking and Adjustment of the Shale Oil Horizontal Well (1) fine analysis and accurate target entering: during a drilling process, timely carrying out horizon calibration by using shallow layer logging curves, and analyzing the accuracy of a stratum velocity; carrying out mutual constraint and verification by using multiple sets of data and multiple interpretation schemes in an objective area to ensure the reasonableness of a seismic geological interpretation; timely adjusting trajectory control parameters according to actual drilling conditions, to ensure accurate target entering; and (2) fine tracking to prevent off-target: carrying out velocity fitting in conjunction with adjacent key well data and the present well data, so that the stratum velocity is most accurate, thereby obtaining the most reasonable actual trajectory; and at the same time performing fine correlation of small layers according to comprehensive mud logging data and logging-while-drilling data, and correcting the trajectory in time to ensure the drilling success rate of a high-quality small layer.

In step A, a standard for identifying shale oil sweet spot intervals is established to divide a single well and determine planar distribution of sweet spots, by using the following logging data: interval transit time, natural gamma, resistivity, and nuclear magnetic logging. In optimal selection of a target area of step B, seismic interpretation and structural mapping are carried out on the top of the shale oil sweet spot interval, and a Ro contour map is drawn according to analytical and test results, wherein the sweet spot buried depth, the degree of evolution of shale and the thickness of the sweet spot interval are coupled to select a favorable exploration target area. In optimal selection of a target layer of step B, fine correlation of oil layers for wells is carried out in subdivisional small layers by using known wells, and a small layer with a large thickness and stable distribution is selected as an objective layer; a layer with obvious identification characteristics in a curve shape or curve value can be used as a comparative marked layer in the area, which has continuous seismic reflection and is easy to track. In optimal selection of a target direction of step B, the attitude of stratum means that the stratum is as flat and straight as possible with few flexural structures; the fault influence means that the well trajectory is 150 m or above away from a fault, and the fracture development direction means that an included angle between the direction of the well trajectory and the direction of a maximum horizontal principal stress is an acute angle greater than 30°. In optimization of a trajectory of step B, a relationship is established between clear geological information of small layers of the oil layers and a seismic reflection event through fine well-seismic calibration, and the seismic event is endowed with geological significance, to increase the horizontal footage in an optimal small layer. In fine analysis and accurate target entering of step C, horizon calibration is carried out timely by using logging curves of sonic waves, resistivity, natural gamma and the like, and the velocity accuracy is analyzed; and constraint and verification are carried out by using multiple sets of data and multiple interpretation schemes. In fine tracking to prevent off-target of step C, velocity fitting is carried out in conjunction with adjacent well data, so that the stratum velocity is most accurate, thereby obtaining the most reasonable actual trajectory.

Embodiment 1

Characteristics of an electrical logging curve of an oil layer are calibrated based on oil test results. By using logging data such as interval transit time, natural gamma, resistivity, and nuclear magnetic logging, a cross plot is constructed, a standard for identifying shale oil sweet spot intervals is established, and the thickness of a shale oil sweet spot for a single well is determined. Refer to FIG. 1, by using $Ek_2^1$ oil group as an example, the distribution area of sweet spots with a thickness of 30 m or above reaches 130 $km^2$.

Seismic interpretation and structural industrialization mapping are performed by using the top of a shale oil sweet spot interval as a plotting layer. A Ro contour map is drawn based on geochemical analysis and test results. The sweet spot thickness and buried depth, and the degree of thermal evolution of shale are coupled for analysis to identify a GD area having shale oil sweet spots with a large thickness, wide distribution and large burial depth. The GD area is preferred as a favorable target area for exploration.

Figure 2:
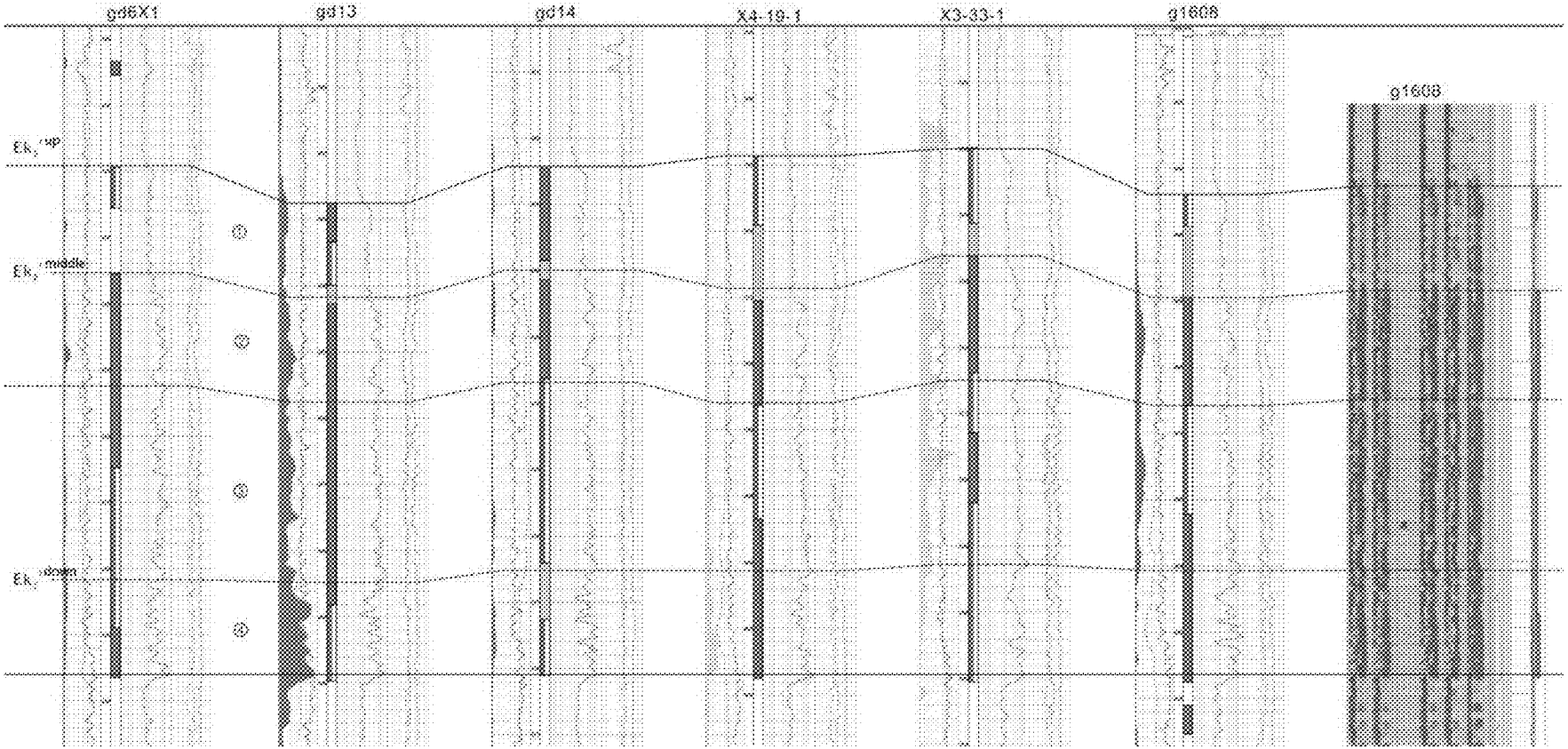
FIG. 2 is a fine correlation diagram of oil layers in the present invention.

Refer to FIG. 2, a key well in the GD area is selected, and based on correlation of oil groups in the past, fine correlation of oil layers in subdivisional small layers is further carried out to optimally select an advantageous target layer based on two principles. According to a first principle of good oil-bearing property, a large thickness, stability and reliability, as the oil-bearing property of $Ek_2^1$ in the longitudinal direction of the GD area is obviously better than that of $Ek_2^2$, and fine correlation of subdivisional small layers in $Ek_2^1$ shows that drilling in ten wells in small layers ②, ③ and ④ of $Ek_2^1$ is successful, and after oil testing, nine wells produce an industrial oil flow, with a thickness of 40-45 m and stable distribution; and according to a second principle that logging curve and seismic reflection characteristics should be easy to identify, as an interval transit time curve of the top of small layer ② of $Ek_2^1$ is in a "W" shape, the small layer can be used as an area marked layer of Eke, and as its resistivity is obviously higher than that in the small layer ①, and the small layer has stable distribution, so the small layer can be used as a comparative marked layer; the resistivity of the small layer ④ at the bottom is obviously higher than that at the top of $Ek_2^2$ oil group and is easy to identify; and in seism, the small layers ②, ③ and ④ correspond to a strong reflection, have stable distribution in the area and are easy to track.

Four well location schemes are proposed for a favorable target layer of $Ek_2^1$. Through geological and engineering combined analysis, further optimal selection is performed in consideration of three factors: attitude of stratum, fault influence, and fracture development direction. Firstly, the stratum should be as flat and straight as possible with few flexural structures, so as to be beneficial for drilling along the layer of a horizontal interval. Secondly, the distance from a fault should be preferably 150 m or above to prevent pressure release from the fault during a large volume fracturing process to affect the fracturing effect. Thirdly, as engineering analysis shows that the fracturing effect can be best when the horizontal well trajectory is vertical to the direction of the maximum principal stress, and their included angle should be at least not less than 30°, and existing data shows that the direction of the maximum principal stress in the area is 45-60°, a direction of approximately 90° is finally selected as an optimal target direction after comprehensive analysis.

Figure 3:
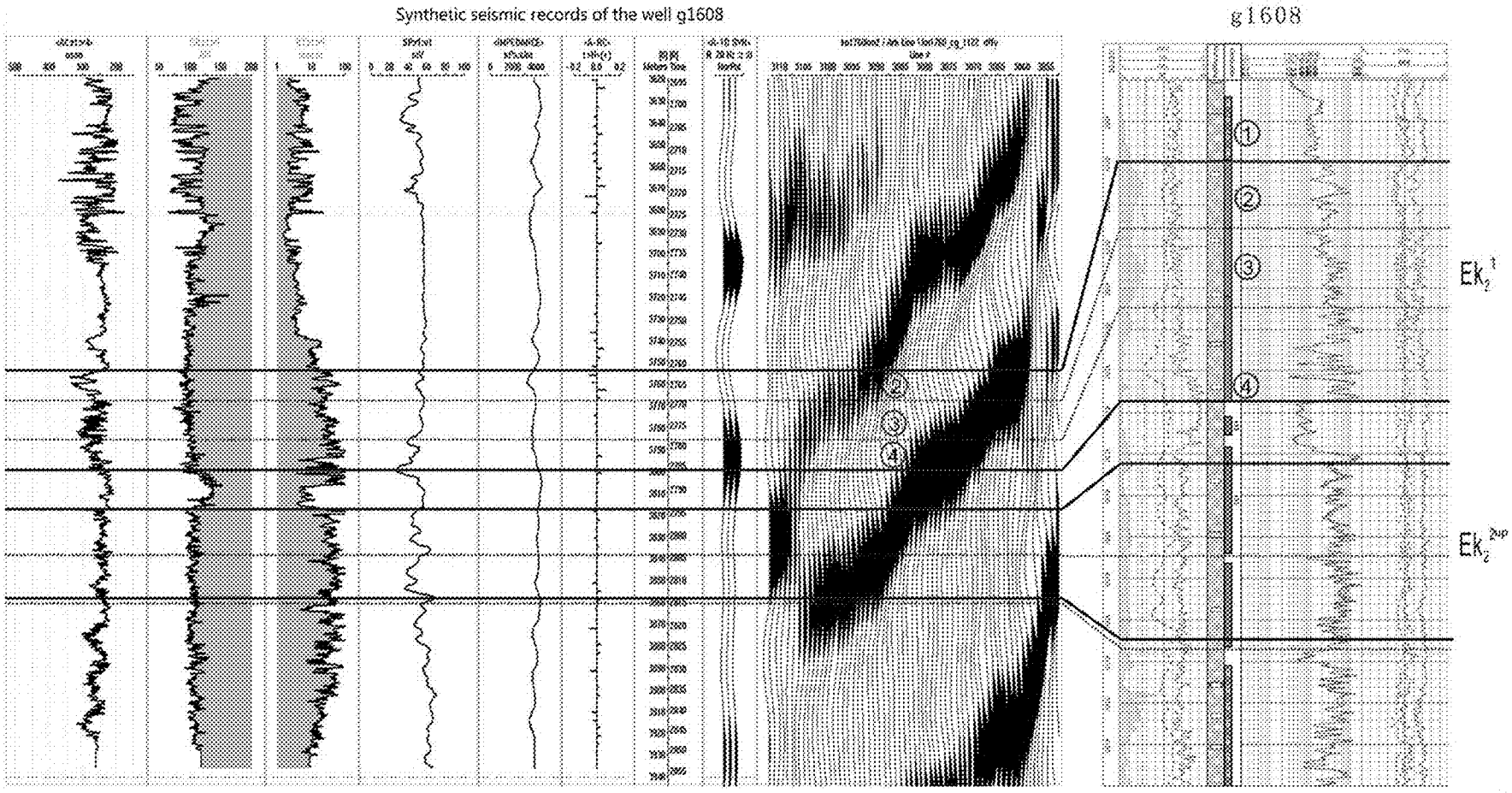
FIG. 3 is a fine well-seismic calibration diagram of the representative well g1608 in the present invention.
Figure 4:
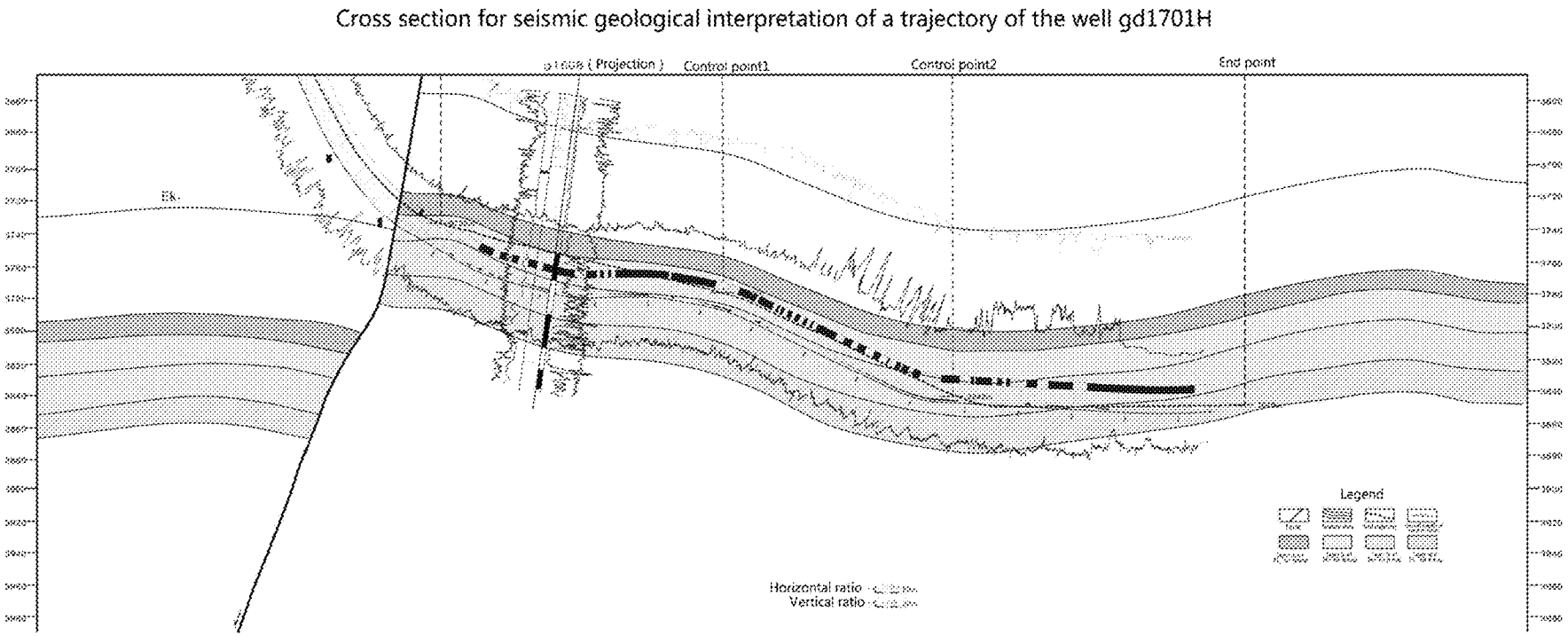
FIG. 4 is a sectional diagram of seismic geological interpretation of a trajectory of a shale oil horizontal well in the present invention.

According to nuclear magnetic logging data of the pilot well g1608, the small layer ② has best porosity, which is 10%, followed by the small layer ④ with a porosity of about 6-8%. However, comprehensive analysis based on lithologic association characteristics, gas logging abnormality, TOC content and free hydrocarbon content shows that the small layers ② and ③ are better. Refer to FIG. 3, Fine seismic calibration is carried out, so that a relationship is established between geological information of small layers of the oil layers and a seismic reflected wave event through fine well-seismic calibration, wherein different phases of the event correspond to the small layers of the oil layers, and the seismic event is endowed with geological significance. Finally, refer to FIG. 4, a trajectory scheme with the small layer ② as the main layer is obtained through optimization.

Figure 5:
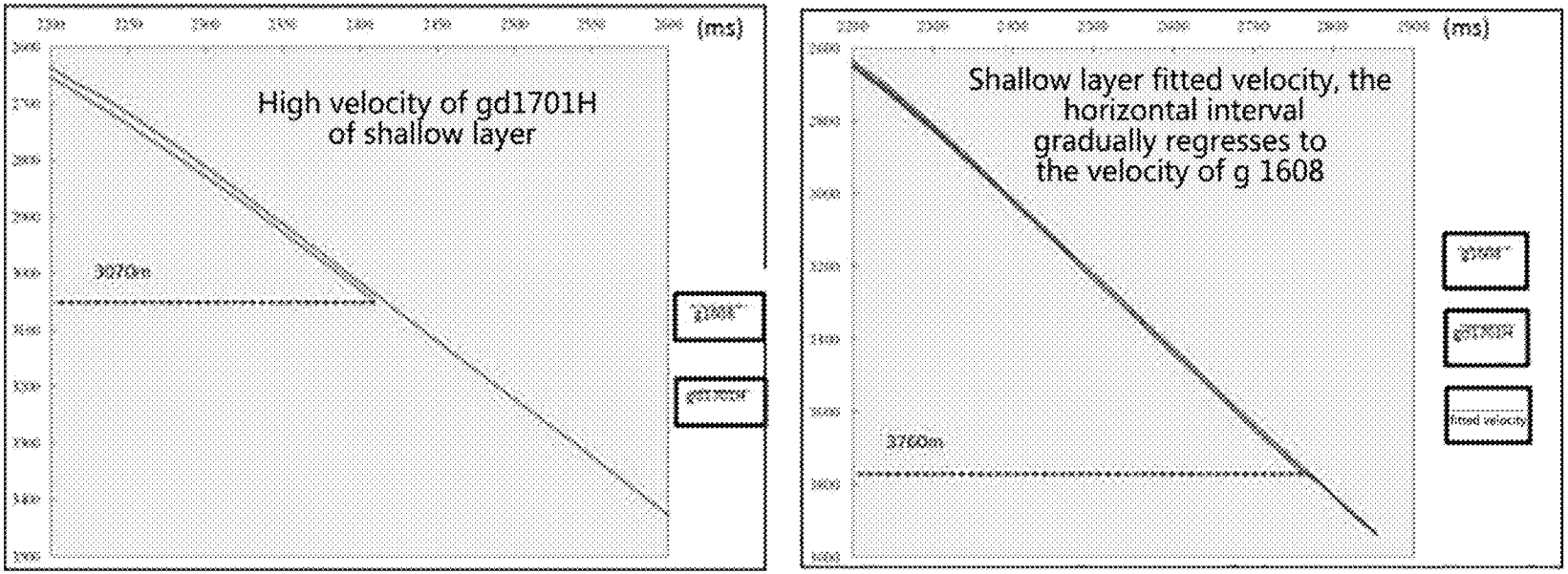
FIG. 5 is a diagram of a time-depth relationship between g1608 and the present well in the present invention.

On-site tracking and adjustment during implementation of the shale oil horizontal well includes two main tasks. The first one is precise analysis for accurate target entering. The accuracy of the velocity and the reasonableness of an interpretation scheme are main factors that determine whether accurate target entering can be achieved. For the velocity, it mainly involves timely making synthetic seismic records for the present well according to shallow layer logging data and carrying out comparative analysis. As to whether the seismic interpretation is reasonable, interpretation schemes of two sets of data are prepared to constrain each other. By comparison, the fault locations of the two schemes are quite different. Refer to FIG. 5, according to a KN jointed 3D scheme, a fault should be passed through when drilling reaches 3795 m, and the lithology and color should change, but the above-mentioned characteristics are not actually seen. Synthetic record calibration is carried out based on shallow layer logging data, and it is found that the actual velocity is larger and the trajectory is higher. After the trajectory is corrected, drilling is further carried out for 40 m, but the fault is still not passed through. It is believed that the velocity may be not the most important influencing factor, but a structural interpretation scheme of XJ target data should be more reasonable. Eventually the fault is passed through when drilling reaches 3962 m, and window entry is successfully achieved when drilling reaches 4012 m. The second task is fine tracking to prevent off-target. It mainly involves carrying out fine correlation based on comprehensive mud logging and logging-while-drilling curves, and correcting the trajectory, to increase the drilling success rate of a high-quality small layer. To ensure the accuracy of the trajectory, first of all, the stratum velocity must be accurate. If the velocity of the pilot well g1608 is adopted, the horizontal well trajectory enters the small layer ③ ahead of time, which is not in conformity with the actual data such as mud logging information. Therefore, the shallow layer velocities of the two wells are fitted, and the horizontal interval gradually regresses to the velocity of the well g 1608, thus obtaining the most reasonable actual trajectory. The trajectory is updated in time. After drilling passes through the well g1608, the inclination is found to be relatively small and there is a risk of exiting the small layer ②. Therefore, the inclination angle is increased in time. In the well section 4261-4282 m, the resistivity suddenly decreases, the carbonate content increases, and the gas logging value also significantly drops. It is suspected that it enters the top of the small layer ③. Due to forecasting to increase the inclination, the trajectory quickly returns to the small layer thereby maximally ensuring the footage of the small layer. By comparing the two data sets, the KN jointed three-dimensional data set is more reasonable for handling the attitude of stratum. Therefore, in the later drilling, adjustments are made in time mainly with reference to the jointed three-dimensional data set to finish drilling successfully. The logging interpretation covers more than 1,400 meters of the oil layers, and the drilling success rate of the oil layers reaches 96%.

It will be apparent to those skilled in the art that the present invention is not limited to the details of the foregoing exemplary embodiments, and the present invention can be implemented in other specific forms without departing from the spirit or basic features of the present invention. Therefore, in every respect, the embodiments should be regarded as exemplary and non-limiting, and the scope of the present invention is defined by the appended claims rather than the above description, and thus, all changes that fall within the meaning and scope of equivalent elements of the claims are intended to be encompassed within the present invention. No reference signs in the claims should be construed as limiting the claims involved.

In addition, it should be understood that although this specification is described by means of embodiments, not every embodiment includes only one independent technical solution. The specification is described in this way for clarity only, and those skilled in the art should regard the specification as a whole. The technical solutions in the embodiments may also be appropriately combined to form other embodiments that can be understood by those skilled in the art.

The invention claimed is:

1. A method for trajectory design and on-site tracking and adjustment of a shale oil horizontal well, comprising:

step A: identifying and evaluating shale oil sweet spots, comprising:

based on analytical and assay results of a system-cored well, carrying out research on a seven-property relationship among source rock, lithology, electrical property, physical property, brittleness, oil-bearing probability and earth stress, establishing a standard for geophysical response characteristics of a shale oil layers for a single well, and determining planar distribution of sweet spots;

Step B: a "four-optimal" method for trajectory design of the shale oil horizontal well, comprising:

(1) optimal selection of a target area: selecting a favorable exploration target area based on the thickness and buried depth of a shale oil sweet spot interval, and its coupling relationship with the degree of thermal evolution of shale;

(2) optimal selection of a target layer: carrying out fine correlation of oil layers in the optimal target area, determining an optimal sweet spot interval based on the principles of a large oil layer thickness, stable distribution, a high drilling success rate of a known well, and easy identification of seismic characteristics in logging;

(3) optimal selection of a target direction: comprehensively analyzing factors including attitude of stratum, fault influence, and fracture development direction of the determined target layer, and selecting an optimal drilling direction; and (4) optimization of a trajectory: carrying out fine seismic calibration, and further optimizing a horizontal well trajectory scheme based on a drilling direction determined by the optimal target direction to ensure a maximum drilling success rate of the optimal sweet spot interval;

Step C: a "two-fine" method for tracking and adjustment of the shale oil horizontal well, comprising:

(1) fine analysis and accurate target entering: during a drilling process, timely analyzing the accuracy of a stratum velocity and the reasonableness of a seismic interpretation scheme, and timely making adjustments to ensure precise target entering; and (2) fine tracking to prevent off-target: performing fine correlation according to comprehensive mud logging data and a logging-while-drilling curve, and correcting the trajectory to ensure the drilling success rate of a high-quality small layer.

2. The method for trajectory designing and on-site tracking and adjusting of a shale oil horizontal well according to claim 1, wherein in the step A, a standard for identifying shale oil sweet spot intervals is established to identify the sweet spots for a single well and determine the planar distribution of the sweet spots, by using following logging data: interval transit time, natural gamma, resistivity, and nuclear magnetic logging.

3. The method for trajectory design and on-site tracking and adjustment of a shale oil horizontal well according to claim 1, wherein in the optimal selection of a target area of the step B, seismic interpretation and structural mapping are carried out on the top of the shale oil sweet spot interval, and a Ro contour map is drawn according to analytical and test results, wherein the buried depth of the shale oil sweet spot interval, the degree of thermal evolution of shale and the thickness of the shale oil sweet spot interval are coupled to select the favorable exploration target area.

4. The method for trajectory designing and on-site tracking and adjustment of a shale oil horizontal well according to claim 1, wherein in the optimal selection of a target layer of the step B, the fine correlation of oil layers for wells is carried out in subdivisional small layers by using the known wells, and a small layer with a large thickness and stable distribution is selected as an objective layer.

5. The method for trajectory design and on-site tracking and adjustment of a shale oil horizontal well according to claim 1, wherein in the optimal selection of a target direction of the step B, the attitude of stratum factor indicates that the stratum is as flat and straight as possible with few flexural structures; the fault influence factor indicates that the well trajectory is 150 m or above away from a fault, and the fracture development direction factor indicates that an included angle between the direction of the well trajectory and the direction of a maximum horizontal principal stress is an acute angle greater than 30°.

6. The method for trajectory design and on-site tracking and adjustment of a shale oil horizontal well according to claim 1, wherein in the optimization of a trajectory of the step B, a relationship is established between clear geological information of small layers of the oil layers and a seismic reflection event through fine well-seismic calibration, and the seismic event is endowed with geological significance, to increase the horizontal footage in an optimal small layer.

7. The method for trajectory design and on-site tracking and adjustment of a shale oil horizontal well according to claim 1, wherein in the fine analysis and accurate target entering of the step C, horizon calibration is carried out timely by using logging curves of sonic waves, resistivity, and natural gamma, and the velocity accuracy is analyzed; and constraint and verification are carried out by using multiple sets of data or multiple interpretation schemes.

8. The method for trajectory design and on-site tracking and adjustment of a shale oil horizontal well according to claim 1, wherein in the fine tracking to prevent off-target of the step C, velocity fitting is carried out in conjunction with adjacent well data, so that the stratum velocity is most accurate, thereby obtaining the most reasonable actual trajectory.

* * * * *